US009963944B2

(12) United States Patent
Wu et al.

(10) Patent No.: US 9,963,944 B2
(45) Date of Patent: May 8, 2018

(54) HYBRID TENSIONING OF RISER STRING OPERATING WITH ENERGY STORAGE DEVICE

(71) Applicant: Transocean Sedco Forex Ventures Limited, George Town Grand Cayman (KY)

(72) Inventors: Yin Wu, Houston, TX (US); Edward Peter Kenneth Bourgeau, Houston, TX (US)

(73) Assignee: Transocean Sedco Forex Ventures Limited (KY)

( * ) Notice: Subject to any disclaimer, the term of this patent is extended or adjusted under 35 U.S.C. 154(b) by 10 days.

(21) Appl. No.: 15/072,206

(22) Filed: Mar. 16, 2016

(65) Prior Publication Data

US 2016/0194925 A1 Jul. 7, 2016

Related U.S. Application Data

(63) Continuation of application No. 13/715,412, filed on Dec. 14, 2012.

(Continued)

(51) Int. Cl.
*E21B 19/00* (2006.01)
*E21B 17/01* (2006.01)

(52) U.S. Cl.
CPC ..... *E21B 19/006* (2013.01); *E21B 17/01* (2013.01)

(58) Field of Classification Search
CPC .... E21B 19/002; E21B 19/004; E21B 19/006; E21B 19/008; E21B 33/0355

(Continued)

(56) References Cited

U.S. PATENT DOCUMENTS 3,669,329 A 6/1972 Blanchet et al.
3,722,769 A 3/1973 Aplet et al.

(Continued)

FOREIGN PATENT DOCUMENTS

JP 10311191 B2 11/1998
JP 2006-101391 A 4/2006

(Continued)

OTHER PUBLICATIONS

PCT International Search Report, dated Feb. 25, 2013 during prosecution of International Application No. PCT/US2012/069863.

(Continued)

*Primary Examiner* — Tara Mayo-Pinnock
(74) *Attorney, Agent, or Firm* — Norton Rose Fulbright US LLP

(57) ABSTRACT

An enhanced riser control system may employ electrical tensioners coupled to a drilling riser by wires. The electrical tensioners may provide quick response to a tension controller to handle positioning of the drilling riser. The electrical tensioners of the enhanced riser control system may be combined with hydro-pneumatic tensioners in a riser hybrid tensioning system. A controller within the enhanced riser control system may be configured to distribute tension to electrical tensioners and to control electrical tensioners to adjust the length of the first and second wires. Energy from an electrical tensioner may be transferred to an energy storage system or to power dissipaters for dissipating the energy generated by the electrical tensioner. The energy transferred from an electrical tensioner may be energy that has been generated by the electrical tensioner.

10 Claims, 12 Drawing Sheets

Related U.S. Application Data

(60) Provisional application No. 61/579,353, filed on Dec. 22, 2011, provisional application No. 61/725,411, filed on Nov. 12, 2012.

(58) Field of Classification Search
USPC ..... 405/224.2, 224.4; 114/230.2–230.24; 166/355
See application file for complete search history.

(56) References Cited

U.S. PATENT DOCUMENTS

| | | | |
|---|---|---|---|
| 4,317,174 | A | 2/1982 | Dean |
| 4,351,261 | A | 9/1982 | Shanks |
| 4,432,420 | A | 2/1984 | Gregory et al. |
| 4,638,978 | A | 1/1987 | Jordan |
| 4,759,256 | A | 7/1988 | Kovit et al. |
| 4,962,817 | A | 10/1990 | Jones et al. |
| 5,209,302 | A | 5/1993 | Robichaux et al. |
| 6,817,422 | B2 | 11/2004 | Jordan |
| 7,080,689 | B2 | 7/2006 | Guesnon et al. |
| 2003/0205383 | A1 | 11/2003 | Jordan |
| 2011/0146556 | A1 | 6/2011 | Yuan |
| 2011/0247825 | A1 | 10/2011 | Batho et al. |

FOREIGN PATENT DOCUMENTS

| | | | |
|---|---|---|---|
| WO | 01088323 | A1 | 11/2001 |
| WO | 2011124470 | A2 | 11/2001 |
| WO | 2009120062 | A2 | 10/2009 |

OTHER PUBLICATIONS

Koch et al., "The Gulf of Mexico Loop Current and Deepwater Drilling", JPT, Sep. 1991, pp. 1046-1050 and 1118-1119.
Gabbai et al., "An overview of modeling and experiments of vortex-induced vibration of circular cylinders", Journal of Sound and Vibration, 282, 2005, 575-616.
He et al., "Robust adaptive boundary control of a flexible marine riser with vessel dynamics", Automatica, 47, 2011, pp. 722-732.
Do et al., "Nonlinear control of an active heave compensation system", Ocean Engineering, 35, 2008, pp. 558-571.
Do et al., "High Performance Control of an Active Heave Compensation System", Proceedings of the 17th World Congress, The International Federation of Automatic Control, Jul. 2008, pp. 5059-5064, Seoul, Korea.
Leira et al., "Vertical Position Control for Top Tensioned Riser with Active Heave Compensator", Proceedings of the ASME 2011 30th International Conference on Ocean, Offshore and Arctic Engineering, OMAE2011, Jun. 2011, pp. 1-10, Rotterdam, The Netherlands.
"Active Heave Compensator", Ocean Drilling Program, www.oceandrilling.org., 2002.
Kuchler et al., "Active Control for an Offshore Crane Using Prediction of the Vessel's Motion", IEEE/ASME Transactions on Mechatronics, Apr. 2011, vol. 16, No. 2, pp. 297-309.
Gu et al., "Modeling, simulation and design optimization of a hoisting rig active heave compensation system", Int. J. Mach. Learn. & Cyber, 2012, 14 pages.
Korde, Umesh A., "Active Heave Compensation on Drill-Ships in Irregular Waves", Ocean Engng, 1998, vol. 25, No. 7, pp. 541-561.
Rustad, Anne Marthine, "Modeling and Control of Top Tensioned Risers", Department of Marine Technology, Norwegian University of Science and Technology, 2007, Thesis, pp. 1-202.
Hock et al., "A Deepwater Riser Emergency Disconnect Antirecoil System", JPT, Aug. 1993, pp. 744-751.
Ofoegbu, Emeka Innocent, "Review of Vortex Induced Vibration of Marine Risers", Cranfield University, School of Applied Science, Sep. 2008, Thesis, pp. 1-62.
Trim et al., "Experimental investigation of vortex-induced vibration of long marine risers", Journal of Fluids and Structures 21, 2005, pp. 335-361.
Vandiver, J. Kim "Research Challenges in the Vortex-Induced Vibration Prediction of Marine Risers", Offshore Technology Conference, 1998, OTC 8698, pp. 1-9 (155-163), Houston, Texas.
Zhang et al., "Control of vortex-induced non-resonance vibration using piezo-ceramic actuators embedded in a structure", Institute of Physics Publishing, Smart Materials and Structures, 14, 2005, pp. 1217-1226.
Howells, Hugh "Deep Water Drilling Riser Technology, VIV & Fatigue Management", Drilling Engineering Association (Europe), 4th Quarter Meeting, 1998, pp. 1-9, Paris, France.
How et al., "Active control of flexible marine risers", Journal of Sound and Vibration, 320, 2009, pp. 758-776.
Ge et al., "Boundary Control of a Coupled Nonlinear Flexible Marine Riser", IEEE Transactions on Control Systems Technology, vol. 18, No. 5, Sep. 2010, pp. 1080-1091.
Delrue et al., "The Application of Supercapacitors Based Energy Storage Systems on Heave Compensation Systems for Offshore Lifting Equipment", ASME 2011 30th International Conference on Ocean, Offshore and Arctic Engineering, OMAE2011, Jun. 2011, pp. 1-7, Rotterdam, The Netherlands.
Sten et al., "Force Variations on Heave Compensating System for Ultra-Deepwater Drilling Risers", ASME 2010 29th International Conference on Ocean, Offshore and Arctic Engineering, OMAE 2010, Jun. 2010, pp. 10, Shanghai, China.
Lang et al., "Recent Developments in Drilling Riser Disconnect and Recoil Analysis for Deepwater Applications", ASME 2009 28th International Conference on Ocean, Offshore and Arctic Engineering, OMAE2009, May/Jun. 2009, pp. 1-14, Honolulu, Hawaii.
Koch, et al., The Gulf of Mexico Loop Current and Deepwater Drilling, JPT, 1991, pp. 1046-1050 and 1118-1119.
Do, et al., High Performance Control of an Active Heave Compensation System, Proceedings of the 17th World Congress, The International Federation of Automatic Control, Jul. 2008, pp. 5059-5064.

HYBRID TENSIONING OF RISER STRING OPERATING WITH ENERGY STORAGE DEVICE

CROSS REFERENCE TO RELATED APPLICATIONS

This application is a continuation of U.S. patent application Ser. No. 13/715,412 to Bourgeau et al. filed on Dec. 14, 2012 and entitled "Hybrid Tensioning of Riser String," which claims the benefit of U.S. Provisional Application No. 61/579,353 to Wu et al. entitled "Enhanced Riser Control System" and filed Dec. 22, 2011, and U.S. Provisional Application No. 61/725,411 to Wu et al. entitled "Riser Hybrid Tensioning System" and filed Nov. 12, 2012, both of which are hereby incorporated by reference.

TECHNICAL FIELD

This disclosure is related to riser control systems. More specifically, this disclosure is related to a riser tensioning control system having electrical tensioners.

BACKGROUND

Safety and performance are important considerations in a drilling riser. With trends over the past decades to exploit resources in deeper waters and harsher environments, ensuring the safety and performance of drilling risers has become a challenging task.

A riser tensioning system aims to compensate for relative motions between a floating drilling rig and the seabed, which are joined by a rigid riser string. In conventional systems, the most widely used riser tensioning system is a hydro-pneumatic riser tensioning system consisting of hydro-pneumatic cylinders, air/oil accumulators, and air pressure vessels. However, there are short-comings in hydro-pneumatic tensioning systems.

First, the response time for a hydro-pneumatic tensioning system is too slow for certain situations. The relatively slow operation of pneumatic systems results in a long control response time, which is the time between issuing a command and force being applied by the tension system. In certain situations, such as during an emergency riser disconnect, the tension changing response may be too slow. The slow, large over-pulling force may accelerate free riser pipes outward, allowing them to jump out, and consequently damage the drilling rig floor and riser pipes.

Second, increasing longitudinal over-pull tension, the conventional method in hydro-pneumatic tensioning systems used to suppress destructive vortex-induced vibration (VIV), causes stress on the supporting equipment, increases wear and tear on the tensioning system, and increases riser pipe fatigue. Furthermore, increasing longitudinal over-pull tension raises safety concerns in situations where a pair of hydro-pneumatic tensioners are receiving maintenance while the drilling rig is experiencing high wave conditions.

Third, a hydro-pneumatic tensioning system is a relatively complex and costly system that requires a significant amount of maintenance and is at risk for hydraulic fluid leakage. A hydro-pneumatic tensioning system includes a hydro-pneumatic cylinder rod and a seal that are exposed to bending due to factors such as vortex-induced vibration (VIV) or unequal and non-linear loading caused by vessel roll and pitch. These factors may cause high failure risk and may require a high maintenance cost to avoid hydraulic fluid leakage and risks of environmental pollution. Furthermore, the complex hydro-pneumatic system includes a significant volume of air accumulators and reservoirs that consume useful floor space on a drilling rig.

SUMMARY

An enhanced riser tensioning system having an electrical tensioner may provide additional stability and performance over conventional riser tensioning systems having only hydro-pneumatic tensioners. The system may enhance the overall safety and reliability of a deepwater riser system. Electric tensioners have quicker response times than hydro-pneumatic tensioners. With quicker response times, electric tensioners may apply variable tensions to provide more accurate heave compensation control, safer anti-recoil control and reducing the fatigue damage by vortex-induced vibration (VIV) on riser string. This riser hybrid tensioning system also brings new functionalities for simplifying the riser operation process, such as (1) a new riser position control operation mode, (2) a new functionality of vessel motion stabilizer and (3) a new functionality of moving riser string between dual drilling stations According to one embodiment, an apparatus includes a first and second electrical tensioner mechanically coupled to a drilling riser via a first and a second wire of a plurality of wires and electrically coupled to a direct current (DC) power distribution bus. The apparatus may also include an energy storage system and a power dissipater, both of which are also coupled to the DC power distribution bus. The apparatus may further include a hydro-pneumatic tensioner mechanically coupled to the drilling riser via a third wire of the plurality of wires. Further, the apparatus may include a controller configured to measure the tension and speed delivered by both the electrical and hydro-pneumatic tensioner. The controller may also be configured to determine the tension for the first and second electrical tensioners based, in part, on the riser load and the measured tension of the hydro-pneumatic tensioner. The controller may be configured to distribute tension to the first and second electrical tensioners, and to control the first and second electrical tensioners to adjust the length of the first and second wires.

The electrical tensioner within the apparatus may include a motor configured to act as a motor or a generator and an energy inverter. The energy inverter may be coupled to the motor and also to the DC power distribution bus. The electrical tensioner may further include a gear box coupled to the motor and include a winch. The winch may be coupled to the gearbox and may be coupled to the drilling riser via the drilling riser wire. The energy inverter within the electrical tensioner may invert AC energy to DC energy or DC energy to AC energy. The controller may be further configured to regulate the torque and power flow in a plurality of energy inverters.

Energy management may be improved on a vessel through the use of energy storage system. For example, energy may be stored in the storage system when the electric tensioner operates as a generator to regenerate energy in the half wave motion of the vessel; and vice versa.

A method for controlling a tension of a riser tensioning system includes measuring a tension delivered by a tensioner. The method may also include determining a tension for a plurality of electrical tensioners based, in part, on the measured tension. The method may further include distributing the determined tension to the plurality of electrical tensioners. The method may also include controlling the plurality of electrical tensioners based, in part, on the determined tension. The method for controlling a tension of a riser tensioning system that includes distributing the determined tension to the plurality of electrical tensioners may be useful in stabilizing a riser in a drilling vessel.

In an embodiment, the delivered tension that is measured may be the tension of a hydro-pneumatic tensioner or an electrical tensioner. In such an embodiment, the tensioning system may be a riser hybrid tensioning system, which is a riser tensioning system that integrates an electrical tensioning system with hydro-pneumatic tensioners.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

The safety and performance of a deepwater riser tensioning system may be improved by using electrical components to control a tension of a riser. A riser hybrid tensioning system may integrate a riser electrical tensioning system with existing hydro-pneumatic tensioners to improve safety and functionality over conventional riser tensioning systems. A riser tensioning system may also include only electric tensioners. Electrical components, such as an electrical machine, can provide a control response in the range of milliseconds, which is a nearly instantaneous control response. Use of electrical components allows quick response that improves safety and functionality by allowing the tensioning system to respond to different conditions faster. Moreover, additional functionality of a riser hybrid tensioning system may provide enhanced modes of operation to solve numerous problems encountered on deepwater riser tensioning systems.

Figure 1A:
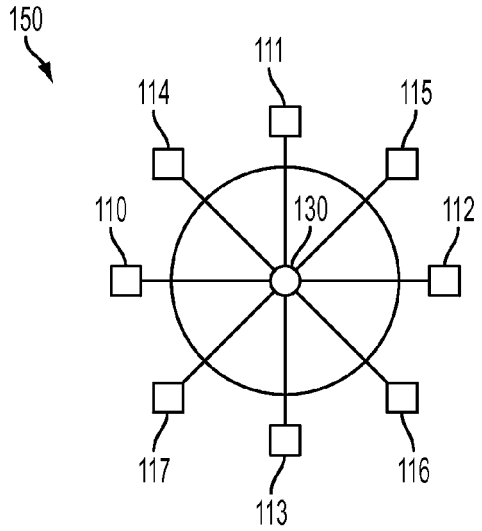
FIG. 1A is a block diagram illustrating a top view of a riser electrical tensioning system according to one embodiment of the disclosure.

FIG. 1A is a block diagram illustrating a top view of a riser electrical tensioning system 150 according to one embodiment of the disclosure. A riser 130 may be coupled to the electrical tensioners 110-117 by ropes. Although FIG. 1A depicts the electrical riser tensioning system 150 with eight electrical tensioners 110-117, the electrical riser tensioning system 150 is not limited to this specific number of electrical tensioners 110-117. For example, in another embodiment, an electrical riser tensioning system may include four electrical tensioners.

Figure 1B:
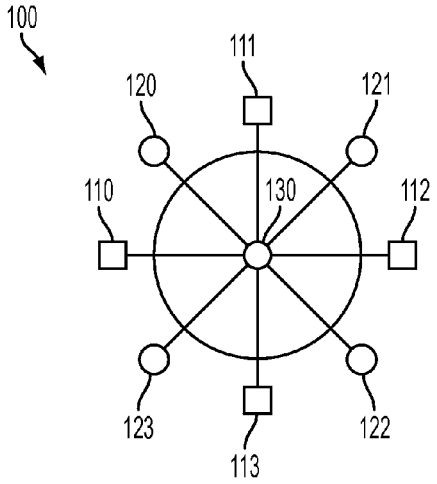
FIG. 1B is a block diagram illustrating a top view of a riser hybrid tensioning system according to one embodiment of the disclosure.

FIG. 1B is a block diagram illustrating a top view of a riser hybrid tensioning system 100 according to one embodiment of the disclosure. The riser 130 may be coupled to electrical tensioners 110-113 and hydro-pneumatic tensioners 120-123 by ropes. Together the electrical tensioners 110-113 and hydro-pneumatic tensioners 120-123 may form the riser hybrid tensioning system 100. Although many of the short-comings of riser tensioning systems that employ only hydro-pneumatic riser tensioners 120-123 have already been detailed, hydro-pneumatic tensioners 120-123 may be used in a riser hybrid tensioning system 100 to take advantage of the benefits of hydro-pneumatic tensioners 120-123. For example, a riser hybrid tensioning system 100 with hydro-pneumatic tensioners 120-123 may have good reliability because the hydro-pneumatic tensioners 120-123 are passive and self-contained systems that have no energy exchange with external systems. Furthermore, the riser hybrid tensioning system 100 may be more resistant to disturbances and fluctuations of outside systems. Electrical riser tensioners 110-113 add many advantages, such as delivering dynamically variable torque with high accuracy, providing quick control responses, and being easier to install. A riser hybrid tensioning system 100 may therefore benefit from the combined advantages of hydro-pneumatic tensioning systems 120-123 and electrical tensioners 110-113.

Although FIG. 1B depicts the riser hybrid tensioning system 100 with four electrical tensioners 110-113 and four hydro-pneumatic tensioners 120-123, a riser hybrid tensioning system is not limited to this specific number of electrical tensioners and hydro-pneumatic tensioners. For example, in another embodiment, a riser hybrid tensioning system may include six hydro-pneumatic tensioners and four electrical tensioners.

Figure 2A:
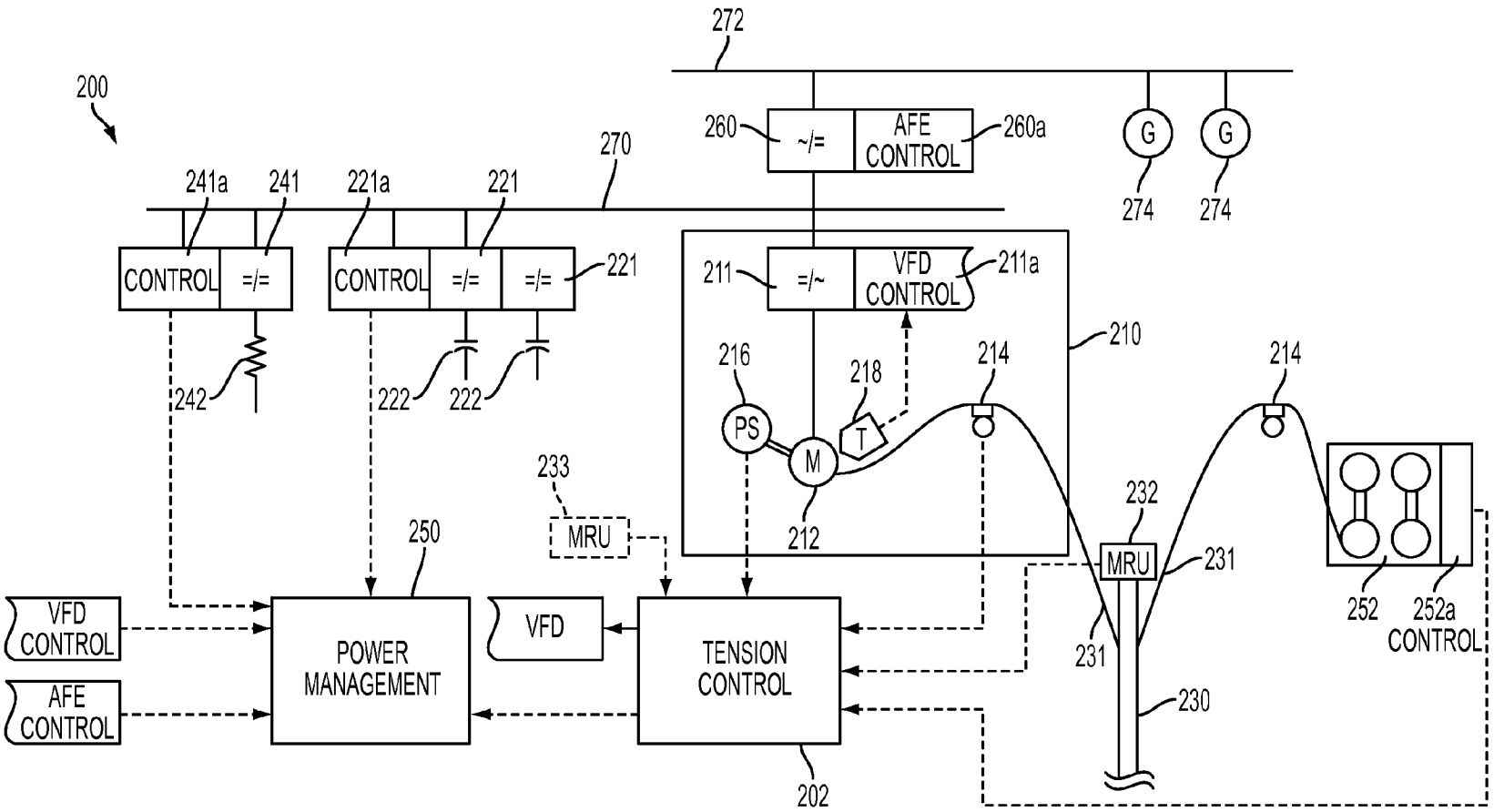
FIG. 2A is block diagram illustrating a riser tensioning system according to one embodiment of the disclosure.

FIG. 2A is block diagram illustrating a riser tensioning system 200 according to one embodiment of the disclosure. The tensioning system 200 may be used to control the tension of wires 231 coupling electrical tensioners 210 to a drilling riser 230. Although only one electrical tensioner 210 is illustrated, additional electrical tensioners may be present, such as illustrated in FIG. 1A above.

The electrical tensioner 210 may be coupled to a common DC power distribution bus 270, which may be shared with other electrical tensioners. The DC bus 270 provides a physical link for the energy flowing into and out of the tensioning system 200, as well as for other power devices. The DC bus 270 may be coupled to an active front end (AFE) rectifier 260 that converts power from an AC bus 272 powered by one or more generators 274. The power module of the AFE rectifier 260 may be controlled by a power management system 250 through an AFE controller 260*a*.

The electrical tensioner 210 may include a variable frequency drive (VFD) 211 to invert energy from AC to DC or from DC to AC. The VFD-type inverter 211 may be controlled by the tension controller 202 through a VFD controller 211*a*. In one direction, the inverter 211 may convert DC energy from the DC bus 270 to AC energy for use by the electrical tensioner 210. In another direction, the inverter 211 may convert AC energy from the electrical tensioner 210 to DC energy that is transferred onto the DC bus 270.

The electrical tensioner 210 may also include a motor 212 coupled by the wire 231 to a sheave 214 and to the riser 230. The motor 212 may be, for example, a high-torque low-speed machine. The motor 212 may be a direct-drive motor, such as an axial-flux permanent magnet disc motor. The motor 212 may controlled by the VFD 211. A position sensor (PS) 216 may be coupled to the electrical tensioner 210 to measure the motor rotating position 231 and to report the position to a tension controller 202. A temperature sensor 218 may be located inside or on the motor 218 and provide feedback to a VFD controller 211*a*. For example, when a temperature measured by the sensor 218 exceeds a safe level, the circulation of an auxiliary cooling system may be increased, or the motor 212 may be shut down to reduce its temperature.

In an all-electric tensioning system, such as illustrated in FIG. 1A, multiple electric tensioners may be coupled to the riser 230 by wires 231. When the tensioning system 200 is a hybrid system, such as illustrated in FIG. 1B, the system 200 may include a hydro-pneumatic tensioner 252 with associated controller 252*a*. Although only one hydro-pneumatic tensioner 252 is illustrated, multiple hydro-pneumatic tensioners may be coupled to the riser 230 through the wires 231. The controller 252*a* may also be in communication with the tension controller 202.

The tension controller 202 may be configured to perform many tasks within a hybrid or electrical riser tensioning system and provide feedback to the power management controller 250. For example, the controller 202 may regulate the torque in the motor 212 for different control purposes through different control algorithms. As another example, the controller 202 may be used as a load sharing controller that distributes tension between the hydro-pneumatic tensioner 252 and the electrical tensioner 210. Furthermore, the controller 202 may be configured to dynamically control the wireline 231 tension. For monitoring and control purposes, status feedback of the electrical tensioners 210, the hydro-pneumatic tensioners 252, the riser 230 and the drilling vessel on which the riser tensioning system is employed may be sent to the controller 202. Alternatively, the controller 202 may calculate the reference signals for both electrical and the hydro-pneumatic tensioners using different control algorithms. The algorithms may be based, in part, on the riser top and the drilling vessel heave relative positions to the seabed, velocity and acceleration from the motion reference unit (MRU) 232, a MRU on the vessel (not shown), and tension measurements of the electrical tensioner 210 and the hydro-pneumatic tensioner 252. Moreover, the controller 202 may be configured to monitor the routing of energy in and out of the electrical tensioner 202 and send this energy signal into the power management controller 250.

The power management controller 250 may be configured to monitor the DC bus 270 voltage and the AC bus 272 frequency. Furthermore, the controller 250 may coordinate power among other power components, such as the electrical tensioner 210, the ultra-capacitor bank 222, and the power dissipater 242.

Referring back to FIG. 2A, in normal operation, a drilling vessel having a riser hybrid tensioning system may experience wave motion that transfers large amounts power to and/or from the electrical tensioner 210. For example, when the vessel experiences waves that cause the vessel to move downward, the electrical tensioner 210 may consume energy from the rig power network 250. The energy consumed by the electrical tensioner 210 may be in the megajoule range, and the required peak power may then be in the megawatt range. When the vessel experiences waves that cause the vessel to move upward, the electrical tensioner 210 may release the same power back onto the DC bus 270. Power fluctuations from the waves may be compensated with elements 222 and 242. That is, by storing energy returned to the DC bus 270 by the energy storage elements 222 or dissipating the energy in energy dissipation elements 242.

The energy storage elements 220 may be coupled to the DC bus 270. Each energy storage element 222 may be coupled to a DC/DC power chopper (DDPC) 221. The specific number and type of energy storage devices 222 used for the energy storage elements 220 may depend on application specific parameters, such as the type of vessel used or the space available for the energy storage elements 220. An energy storage device 222 may be, for example, an ultracapacitor bank (UCB) a battery bank, or a flywheel. When the UCB is used for the energy storage device 222, the UCB may be selected to have a capacity at least 1.2 times the maximum of both the vessel heave of the most significant sea state criterion and five times of the UCB's capacity de-rating.

The tensioning system 200 may also include a power dissipater 242 coupled to the DC bus 270 through a unidirectional power chopper 241. The unidirectional power chopper 241 which may regulate the amount of energy to be dissipated by the power dissipater 242. The power dissipater 242 may be any device that consumes energy, such as a resistor or a heat sink. Operation algorithms within the power management system 250 may route energy into power dissipaters 242 when the energy storage devices 222 are fully charged or when the operating voltages of the UCBs exceed a maximum operating voltage.

Figure 3A:
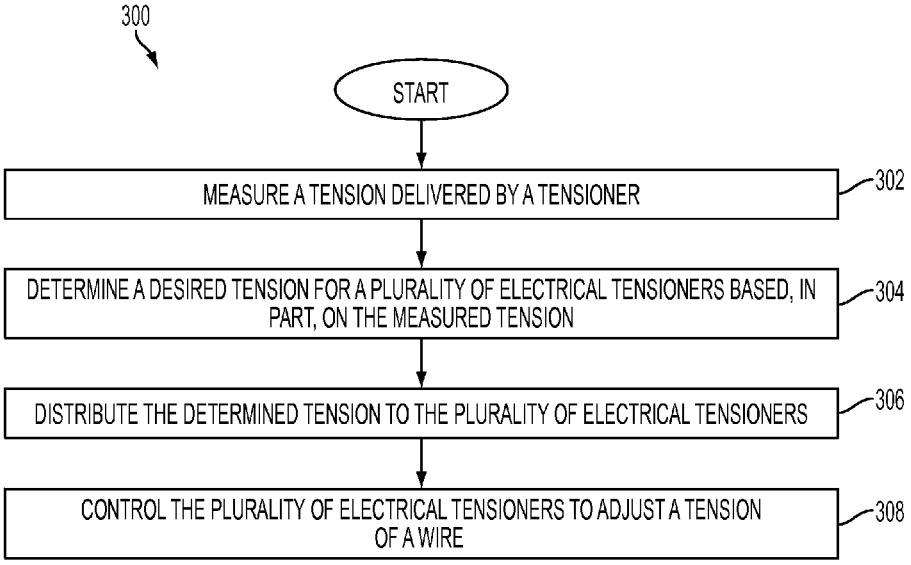
FIG. 3A is a flow chart illustrating a method for controlling the tension of a riser tensioning system according to one embodiment of the disclosure.

FIG. 3A shows a flow chart illustrating a method 300 for controlling the tension of a riser tensioning system according to one embodiment of the disclosure. The method 300 begins at block 302 with measuring a tension delivered by a tensioner within the riser tensioning system. The measured tension may be the tension delivered by a hydro-pneumatic tensioner or an electrical tensioner. In one embodiment, a controller, such as the controller 202 of FIG. 2A, may receive tension feedback signals delivered by the hydro-pneumatic or electrical tensioner to obtain the measured tension delivered by either the hydro-pneumatic or electrical tensioner. In certain embodiments, a plurality of hydro-pneumatic and/or electrical tensioners may be monitored by the controller. In one embodiment, a controller, such as the controller 202 of FIG. 2A, may measure the tension delivered by the hydro-pneumatic or electrical tensioners, while in tensioner.

At block 304, a desired tension for a plurality of electrical tensioners may be determined based, in part, on the measured tension at block 302. Other parameters that may be used to determine the desired tension for a plurality of electrical tensioners include the tension delivered by a hydro-pneumatic or electrical tensioner, a total required tension of the entire riser tensioning system, a total number of hydro-pneumatic tensioners in a riser hybrid tensioning system, and/or a total number of electrical tensioners in the system. Furthermore, the controller 202 of FIG. 2A may be configured to determine the desired tension of the electrical tensioner based, in part, on monitored parameters of a drilling vessel, such as the total number of hydro-pneumatic and electrical tensioners on the vessel.

At block 306, the desired tension of block 304 may be distributed to the plurality of electrical tensioners. The plurality of electrical tensioners may then be controlled to deliver the determined tension by evenly rolling in or rolling out a wire coupled to a respective electrical tensioner of the plurality of electrical tensioners.

According to one embodiment, the desired tension of an electrical tensioner, or a plurality of electrical tensioners, may be calculated using the following equation:

$$T_{ETi}(t) = \left(T_{Total}(t) - \sum_{i=1}^{n_{HT}} T_{HTi}(t)\right) / n_{ET},$$

where $T_{ETi}$ may denote the desired tension of an individual electrical tensioner i, and $T_{HTi}$ may be the tension delivered by hydro-pneumatic tensioner i at any given time, and $T_{Total}$ may represent the total desired tension of the entire riser hybrid tensioning system. The $n_{HT}$ and $n_{ET}$ parameters may be the total number of hydro-pneumatic and electrical tensioners, respectively, in the system.

At block 308, the plurality of tensioners may be controlled based, in part, on the tension that was determined at block 304 and that was distributed at block 306. For example, the tensioners may apply a tension to the wires. The plurality of electrical tensioners may be controlled and coordinated to satisfy different control purposes. This may assist in stabilizing a riser in an offshore drilling vessel. For example, the measuring of the tension delivered by tensioners may be performed continuously to dynamically calculate the desired tension of a tensioner and control the tension being delivered by tensioners. This may ensure that the total delivered tension by the hydro-pneumatic and/or electrical tensioners remains nearly constant. In one embodiment, the controller 202 of FIG. 2A may be configured to control the plurality of electrical tensioners and adjust the wireline tension according to different drilling operation and sea condition. The actions disclosed at the blocks of FIG. 3A may be performed continuously, and in parallel, with the actions that manage the energy in the system, such as those described at blocks 330 and 340 of FIG. 3B.

Figure 3B:
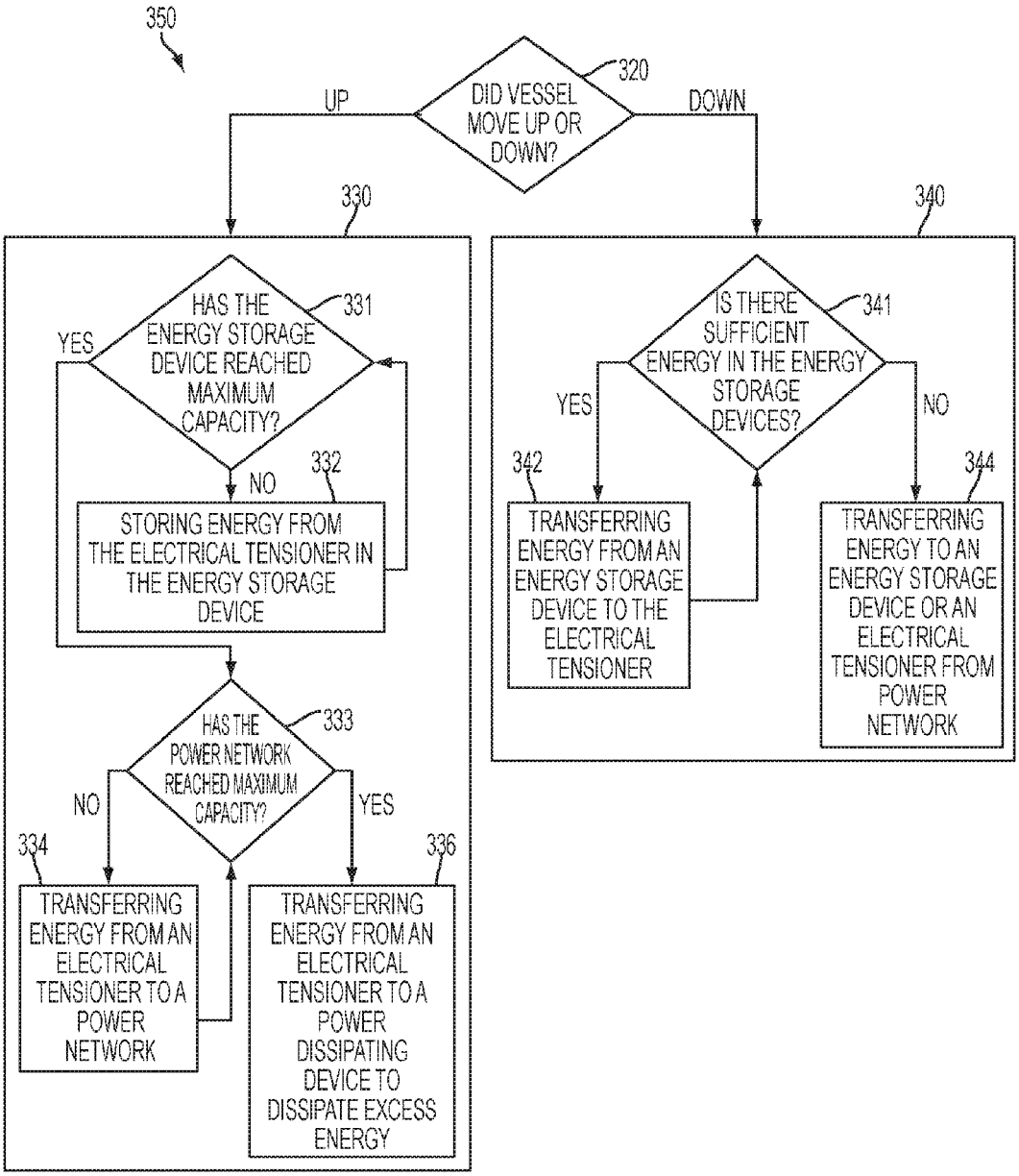
FIG. 3B is a flow chart illustrating a method for controlling energy transfer within a riser tensioning system according to one embodiment of the disclosure.

FIG. 3B is a flow chart illustrating a method for controlling energy transfer within a riser tensioning system according to one embodiment of the disclosure. The actions of method 300 of FIG. 3A may be performed continuously, and either sequentially or in parallel, with the actions of method 350 of FIG. 3B.

At block 320, it is determined whether a vessel has moved vertically up or down. In one embodiment, the vessel being monitored for vertical movement may be an offshore drilling vessel on which a riser tensioning system, as in FIG. 1A, or riser hybrid tensioning system, as in FIG. 1B, is located. The vertical motion of the vessel may be caused by waves in the ocean.

At block 320, when the vessel has moved down, the method 350 may proceed to block 330 where energy may be transferred from an electrical tensioner to energy storage devices. That is, the motor of the electrical tensioning system may act as a generator when the vessel moves up. At block 330, the energy from an electrical tensioner may be transferred to the energy storage system or to power dissipaters for dissipating the energy generated by the electrical tensioner. The energy transferred from an electrical tensioner may be energy that has been generated by the electrical tensioner. For example, when the vessel moves up, the wire coupled to the electrical tensioner may roll out. As the wire rolls out, the motors may act as generators converting potential energy to AC electrical energy. The generated AC electrical energy may be inverted to DC energy by an AC/DC inverter and flow onto a common DC power distribution bus where it may then be transferred to the energy storage devices for storage.

Decisions may be made to determine where the energy generated from an electrical tensioner should be routed. For example, at block 331, it is determined if an energy storage device has reached its maximum energy capacity. At block 332, the energy generated by an electrical tensioner may be transferred to the energy storage device for storage if it was determined at block 331 that the energy storage device had not reached its maximum capacity. Energy generated by an electrical tensioner may continue to be stored in the energy storage device or devices until the energy storage device or devices have reached their maximum energy capacity. As energy is stored in the energy storage device or devices, the energy in the energy storage device or devices may be monitored to determine at block 331 if the maximum energy capacity has been reached.

After the determination at block 331 that the energy storage devices in the electrical tensioning system have reached their maximum energy capacity, it may be determined at block 333 if a power network has reached capacity. In an embodiment, a safe operation criterion or threshold for the power network may serve as an aid in determining whether the power network has reached capacity. At block 334, the energy generated by an electrical tensioner may be transferred to the AC power network for other power consumption if it was determined at block 333 that the power network had not reached its maximum capacity. Energy generated by an electrical tensioner may continue to be transferred into the AC power network until the power network has reached its maximum energy capacity. As energy is absorbed in the power network, the frequency of the power network may be monitored to determine at block 333 if the maximum energy capacity has been reached. At block 336, the energy generated by an electrical tensioner may be transferred to a power dissipating device to dissipate excess generated energy if it was determined at block 333 that the power network had reached its maximum capacity.

If it is determined at block 320 that the vessel has moved down, the method 350 may proceed to block 340 where energy may be transferred from energy storage devices to the electrical tensioner. For example, when the vessel moves down, the wire coupled to the electrical tensioner may roll in. Energy stored in energy storage devices may be transferred onto the common DC power distribution bus where it can be transferred to an electrical tensioner. The energy transferred from the energy storage devices to the DC bus may be inverted to AC energy by the AC/DC inverter in an electrical tensioner. The inverted AC energy may be converted from AC electrical energy to potential energy by the motor in an electrical tensioner to control the tension in the wire. The energy stored in the energy storage device that is transferred to an electrical tensioner may be energy that has been stored in the energy storage device when the vessel last moved down or energy that was provided by charging from the power network.

At block 340, the energy transferred to the electrical tensioner may also be transferred from the AC power network. Furthermore, energy from a power network may also be transferred to an energy storage device to charge it at block 340.

Decisions may be made to determine from where energy for an electrical tensioner should be routed. For example, at block 341, it is determined if an energy storage device has sufficient energy stored. In an embodiment, an energy storage device that has sufficient energy stored may be one that has energy amounting to a predetermined percentage of its maximum capacity. For example, a minimum level in a UCB may be 20% of a total capacity or 40% of a nominal voltage. At block 342, energy may be transferred to an electrical tensioner from an energy storage device if it was determined at block 341 that the energy storage device had sufficient energy stored. Furthermore, at block 342, the energy transferred to an electrical tensioner may be transferred from a plurality of energy storage devices if it was determined at block 331 that the plurality energy storage devices had sufficient energy, and the energy transferred may be transferred to a plurality of electrical tensioners. Energy may continue to be transferred to an electrical tensioner from the energy storage device or devices until the energy storage device or devices have become depleted or become discharged below a predetermined percentage of the maximum capacity. As energy is transferred from the energy storage devices, the energy in the energy storage devices may be monitored to determine at block 341 if they have sufficient energy to continue operating the electric tensioners.

According to an embodiment, after the determination at block 341 that the energy storage devices in the electrical tensioning system do not have sufficient energy, at block 344, the energy transferred to an electrical tensioner may be transferred from the DC bus. For example, additional power may be transferred from generators to the DC bus through an AC-to-DC converter. Furthermore, energy may be transferred from the DC bus to the energy storage devices that are discharged or depleted to charge the energy storage devices. By charging the depleted energy storage devices, the energy required by electrical tensioners may be transferred from the energy storage devices the next cycle the vessel moves up.

Through the management of energy described in method 350 of FIG. 3B, the electrical tensioning system may be an independent energy conversion system with nearly zero energy consumption from the DC bus other than losses by the tensioners.

Figure 4A:
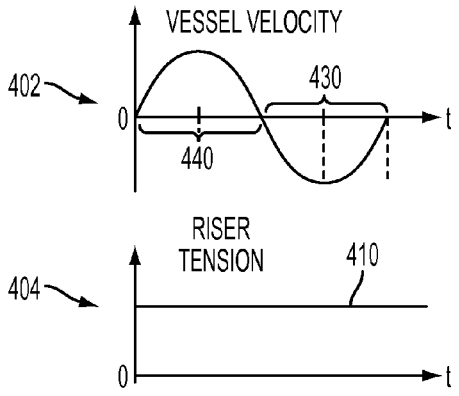
FIG. 4A is a graph illustrating a relationship between vessel velocity and riser tension according to one embodiment of the disclosure.

FIG. 4A is a graph illustrating a relationship between vessel position and riser tension according to one embodiment of the disclosure. The vessel position versus time graph 402 provides an illustration of the movement that a vessel may experience. When the vessel moves down, such as during a region 430, an electrical tensioner may receive energy from either the energy storage devices or the power network. In one embodiment, during the time region 430, the actions at block 340 of FIG. 3B may be performed, because the decision at block 320 may determine that the vessel moved vertically down during this time region. When the vessel moves up, such as during a region 44030, an electrical tensioner may generate energy that can be stored in the energy storage system, transferred to the power network, or dissipated in a power dissipater. Furthermore, the actions at block 330 of FIG. 3B may be performed, because the decision at block 320 may determine that the vessel moved up during this time region.

The riser tension versus time graph 404 provides an illustration of the total tension delivered by the hydro-pneumatic and/or electrical tensioners across time. The total tension 410 may be maintained nearly constant at all times despite the vessel's vertical position fluctuations indicated in the vessel position versus time graph 402.

Figure 4B:
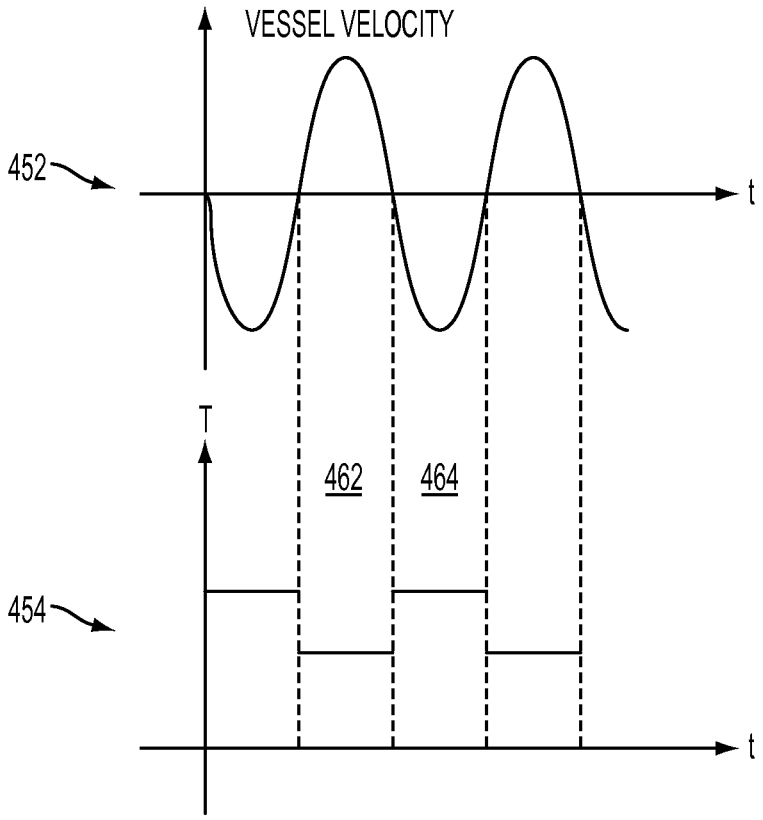
FIG. 4B is a graph illustrating a relationship between vessel velocity and riser tension according to one embodiment of the disclosure.

FIG. 4B is a graph illustrating a relationship between vessel velocity and riser tension according to one embodiment of the disclosure. A graph 452 traces vertical velocity of a vessel experiencing waves in an ocean. A graph 454 traces tension delivered to a wire during the same time period as graph 452. During a first half of the wave period while the vessel is falling, a smaller tension is applied to the line in time period 464. During time period 464, less energy is converted to potential energy by the electric tensioners. During the second half of the wave period while the vessel is rising, a larger tension is applied to the line in time period 462. During time period 462, electrical energy may be harvested from the wave motion in order to compensate the system losses and to increase the reliability during AC power network black out situation.

Figure 4C:
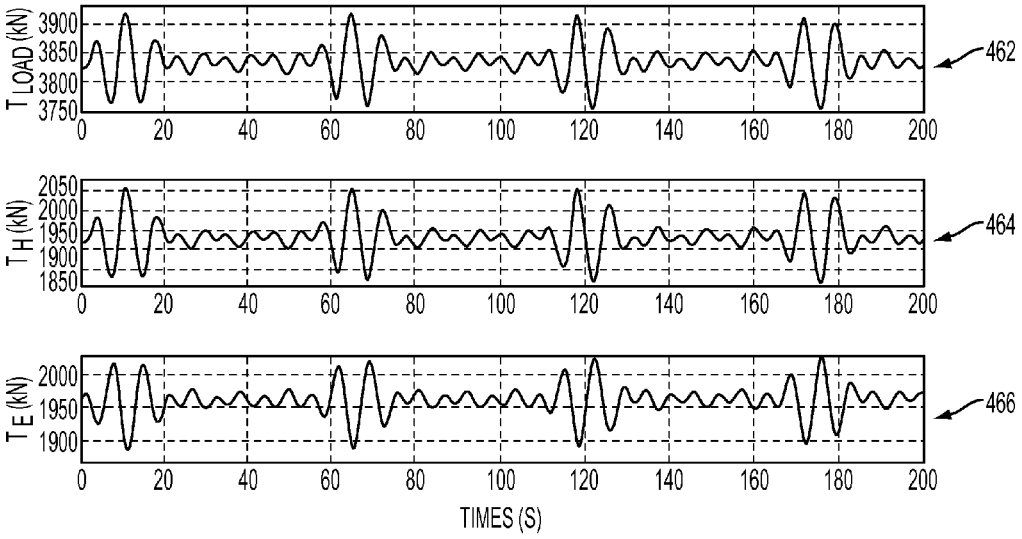
FIG. 4C is a graph illustrating tension applied by electric and hydro-pneumatic tensioners in a riser hybrid tensioning system according to one embodiment of the disclosure.

The overall performance of a riser hybrid tensioning system is illustrated in FIG. 4C, which illustrates graphs of tensions within the riser hybrid tensioning system according to one embodiment. FIGS. 4A-4C illustrate the AC portion of the tensions. The y-axis of each graph ignores the DC portion of the tensions. Each of the tensions may be nearly constant, only varying in a small range as shown in the AC portions. A graph 464 illustrates a required load tension as measured at the top of a riser. A graph 464 illustrates tension delivered by a hydro-pneumatic tensioner, and a graph 466 illustrates tension delivered by an electric tensioner. The tension applied by the electric tensioner in graph 466 is 180 degrees out of phase from the tension applied by the hydro-pneumatic tensioner in graph 464, such that the summation of the tension delivered by the hydro-pneumatic tensioner and the electric tensioner provides the required tension illustrated in graph 462. In using the riser hybrid tensioning disclosed above, heave compensation, which may be controlled by the controller 202 of FIG. 2A, may have a higher level of accuracy. Thus, the riser cyclical fatigue life may be improved by using the riser hybrid tensioning system.

Figure 5:
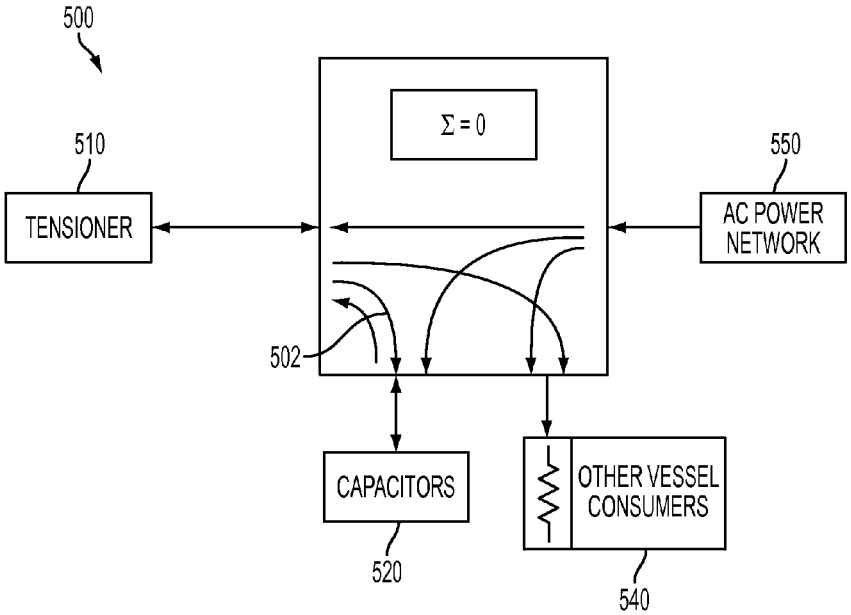
FIG. 5 is a block diagram illustrating routing of energy within a riser hybrid tensioning system according to one embodiment of the disclosure.

FIG. 5 is an illustration 500 of the routing of energy in a riser hybrid tensioning system according to one embodiment of the disclosure. The illustration 500 may visually depict the management and routing of energy as described in FIG. 3B. In one embodiment, the AC power network 550, power dissipater 540, tensioner 510, and the ultra-capacitor bank 520 in FIG. 5 may be the AC power network 272, power dissipater 240, electrical tensioner 210, and the energy storage device 220 described in FIG. 2A, respectively. As one example, arrow 502 illustrates that energy may be transferred from a UCB 520 to an electrical tensioner 510 as described at block 342 of FIG. 3C. In one embodiment, the controlling of the routing of energy to and from different elements within the riser hybrid tensioning system may be performed by the controller 250 of FIG. 2A.

Figure 6:
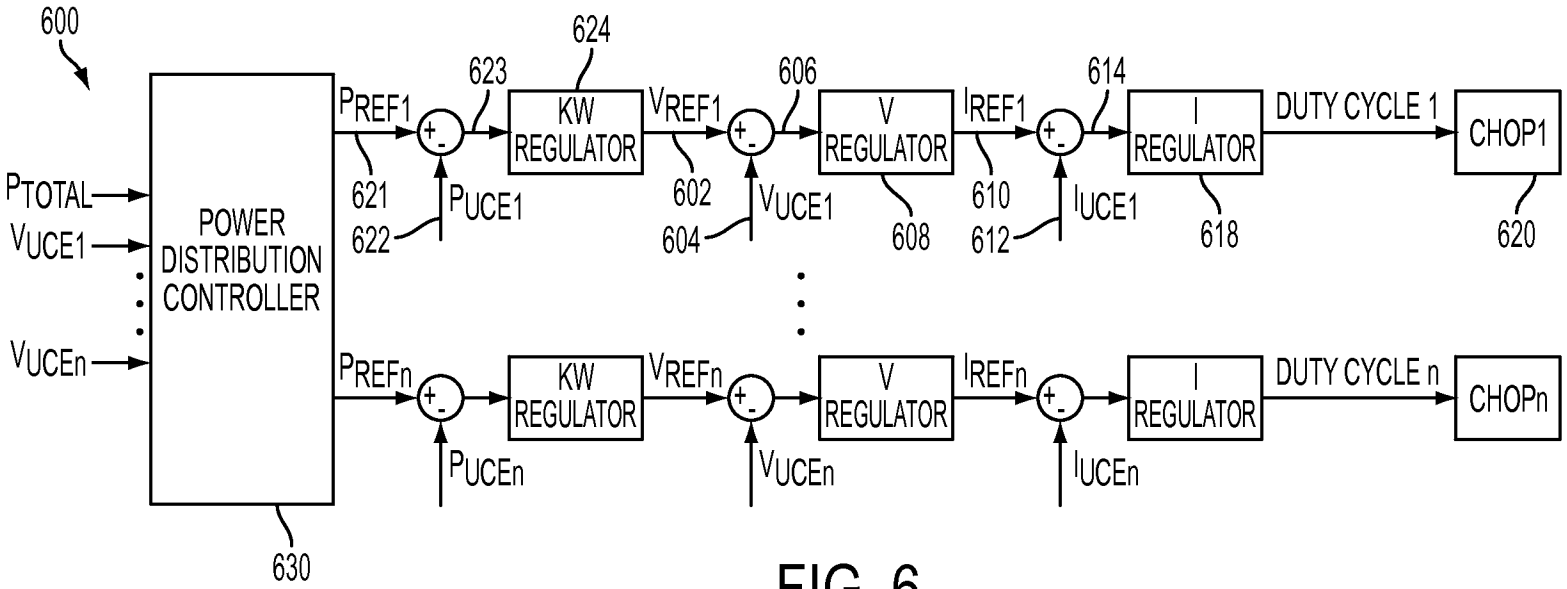
FIG. 6 is a block diagram illustrating a control scheme for energy storage devices according to one embodiment of the disclosure.

FIG. 6 depicts a control scheme 600 for energy storage devices according to one embodiment of the disclosure. In this embodiment an energy storage device to be controlled may be a ultra-capacitor bank (UCB), and the DC/DC power chopper DDPC 620 in FIG. 6 may be the DDPC 221 of FIG. 2A. According to the embodiment, a feedback controller with faster sampling rate may be used to regulate the power, voltage, and current inside of each UCB based on a signal received from the power management controller. An outer power control loop may defines a UCB voltage set point. a control loop, which may predefine a UCB voltage set point, may force a UCB to supply or absorb power according to a kW reference received from an upper-level coordination controller, such as the controller 250 of FIG. 2A. A difference 623 between a reference power 621 and a measured UCB power 622 may be transmitted through a power regulator 624 that may set an UCB voltage reference 602. A difference 606 between a reference voltage 602 and a measured UCB voltage 604 may be transmitted through a voltage regulator 608 that may set an UCB current reference 610. Furthermore, the DDPC's duty cycle 618 may be generated by a current regulator 616 based on an error 614 between the current reference 610 and a measured current 612. This control scheme 600 may enable UCBs to compensate for energy demand in a tensioner system. The control scheme may be implemented with a controller 630, which may control more than one DDPC 620 in parallel.

A power management controller may be used in this topology to keep energy equalized in each UCB, in order to avoid over-depletion of a certain UCB, so that the life cycles of all UCBs are balanced. When an energy surge is regenerated from the electrical tensioners, the amount of power flowing into an energy storage system may be distributed to each UCB according to the percentage of its free volume versus the total free volume of all UCBs, as shown in $$P_i = \frac{C_i(V_{i_FULL}^2 - V_i^2)}{C_1(V_{1_FULL}^2 - V_1^2) + \ldots + C_i(V_{i_FULL}^2 - V_i^2) + \ldots + C_n(V_{n_FULL}^2 - V_n^2)} P_{TOTAL}$$

where $P_i$ with u=1, n is the power distributed to the $i^{th}$ UCB, $P_{TOTAL}$ is the total power regenerated from the tensioning system, $C_i$ is the capacitance of the $i^{th}$ UCB, $V_i$ and $V_{i_FULL}$ are the actual voltage and the nominal voltage of the $i^{th}$ UCB. When energy is consumed by electrical tensioners, the amount of the power transferred out of the energy storage system may be withdrawn from each UCB according to the percentage of its state of charge (SOC) versus the total SOC of all UCBs, as shown in:

$$P_i = \frac{C_i V_i^2}{C_1 V_1^2 + \ldots + C_i V_i^2 + \ldots + C_n V_n^2} P_{TOTAL}$$

With the novel riser hybrid tensioning system disclosed, several control modes employed in riser control systems may be enhanced, such as active heave compensation control, anti-recoil control, vortex-induced vibration (VIV) suppression control, and riser position control. Quicker response times provide a dynamic response profile that may prevent the riser from jumping out during anti-recoil operation. Furthermore, the riser hybrid tensioning system may deliver variable tensions that may actively suppress VIV.

Several control modes may be implemented that utilize the riser hybrid tensioning system disclosed above, such as an active heave compensation control mode. In this control mode the electrical tensioning system may be set to track a desired vessel heave trajectory in the riser top reference frame to keep the tension applied at the riser top to be within a safe range.

The entire active heave compensation control algorithm may be embedded into the controller 202 in FIG. 2A to calculate torque references and to control the active heave compensation system. The calculated reference signals can be input into an AC/DC inverter to effectively control the motor to roll in or roll out the wire in the electrical tensioning system so as to optimize the total delivered tension by both electrical and hydro-pneumatic tensioners for compensating the force disturbances induced on riser and the acceleration of all moving mechanics, as shown in FIG. 4C. In using the riser hybrid tensioning system disclosed above, heave compensation, which may be controlled by the controller 202 of FIG. 2A, may have an improved control response time and a higher level of accuracy. Thus, the riser cyclical fatigue life may be improved by using the riser hybrid tensioning system.

In one embodiment, another control mode that may be used is an anti-recoil mode to bring the riser string up in a controlled manner according to a desired goal such as to achieve a desired water clearance from the riser bottom to the top of LMRP or to maintain a safe air gap distance from the drill floor to the riser top at the instant of end stop. In this control mode, the control strategy for the electrical tensioner may be a fixed relationship function between the motor output torque and the wire relevant displacement. The fixed relationship strategy may be embedded into a controller, such as the controller 202 of FIG. 2A, to control the electrical tensioners during an emergency disconnect scenario in which the riser tensioning system may be in an anti-recoil mode. Another embodiment for anti-recoil control using the riser hybrid tensioning system may include a feedback control strategy that controls the tension delivered by electrical tensioners and its relative displacement to achieve a controlled deceleration profile of the riser string until it stops. This control algorithm for the anti-recoil mode may also be embedded into a controller. For example, the controller 202 of FIG. 2A, when operating in anti-recoil mode, may be configured to control the electrical tensioners to reduce the upper pulling force on a drilling riser.

Figure 2B:
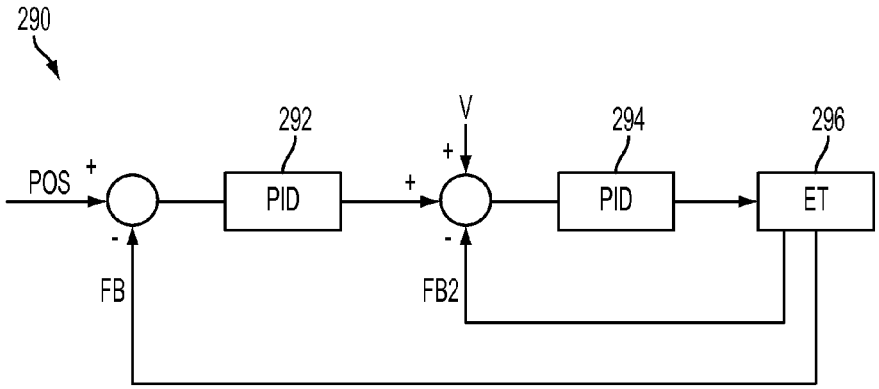
FIG. 2B is a block diagram illustrating a controller for the riser tensioning system according to one embodiment of the disclosure.

FIG. 2B is a block diagram illustrating an anti-recoil controller for the riser tensioning system according to one embodiment of the disclosure. A controller 290 may include cascade proportional-integral-derivative (PID) controllers for controlling a riser hybrid tensioning system. A first PID controller 292 may receive a reference position signal POS from the controller 202 of FIG. 2A, and a feedback signal (FB) from an electric tensioner (ET) drive 296 from the position sensor 216 of FIG. 2A. The first PID controller 292 may be an outer loop of the controller 290 for performing wire-line displacement control. The output of the first PID controller 292 is provided as an input to a second PID controller 294, which also receives information regarding the vessel velocity (V), such as from the motion reference unit (MRU) 233 sitting on the vessel body of FIG. 2A, and a feedback signal (FB2) from the ET drive 296. The second PID controller 294 may be an inner loop of the controller 290 for performing wire-line velocity control.

An anti-recoil trigging method may be comparing the relative vertical movement between the MRU232 of FIG. 2A located on the riser and an MRU 233 of FIG. 2A on the vessel body. If the difference exceeds a certain limit, the anti-recoil system may be triggered.

Furthermore, a riser-mounted MRU may measure second-order transient shock waves in the riser caused by riser disconnection. Because the second-order transient shock wave travels along the riser at a much faster rate than velocity of the riser main body, recoil of the riser may be detected quicker by monitoring the second-order transient shock wave. When a shock wave is detected, hydro-pneumatic tensioners may be unloaded from the riser and the electrical tensioners could adjust tension on the riser to counteract the riser recoil.

The riser hybrid tensioning system may operate in a control mode for VIV suppression that compensates the disturbances induced at the top of a riser to reduce the VIV and extend riser fatigue life. A comparison of relative horizontal position or velocity may be performed between the MRU232 of FIG. 2A located on the riser and an MRU 233 of FIG. 2A on the vessel body. With a suitable model for the riser and a suitable control algorithm, the electrical tensioner controlled by the controller 202 of FIG. 2A may decrease the VIV magnitude and frequency, therefore reduce the fatigue damage of the riser pipe and increase the whole riser systems availability. Using riser hybrid tensioning system could be set to stabilize the riser top at the small neighborhood of its original position, i.e., to reduce the vibration displacement of the riser in x and y axis in transverse reference plane. The destructive vortex-induced vibration is in fact an unsteady resonant oscillation condition that causes the riser fatigue failure over time. Another VIV control strategy may set to prevent the riser string vortex shedding from entering the riser natural frequency by applying dynamic top tensions in vertical directions. For example, the VIV pattern in water may be collapsed by introducing a small disturbance into the resonant potential and kinetic energy from the top of the riser.

An active riser position control may be applied using this hybrid riser tensioning system, implemented in the controller 202 of FIG. 2A to position and/or relocate a riser string. For example, a riser string disconnected from a blow-out preventer (BOP) may hang from the vessel while the vessel relocates to a new well center. During this time, the riser string may act as a spring that amplifies waves in the ocean. Electrical tensioners may be used to control the accurate position in water to eliminate the mass spring effect in the riser string during movement of the riser string from one well center to another well center.

Electric tensioners may also be used to reconnect a lower marine riser package (LMRP) at the end of a riser string back onto blowout preventer. The riser hybrid tensioning system may provide precise LMRP position control which may reduce the time consumed in reconnecting the LMRP onto a blowout preventer (BOP) in comparison a hydro-pneumatic system. The riser hybrid tensioning system may directly and securely land the LMRP back onto the BOP through the leveraging of the electrical tensioners with proper maneuver of remotely operated vehicles. Furthermore, an operator may control the appropriate distance between the LMRP and the BOP. The controller, now operating in riser reconnection mode, may be configured and operated in position control mode to control the distance between the LMRP and the BOP by compensating vessel heave motion. According to one embodiment, the LMRP may be coupled to the BOP, such that the LMRP and BOP are being placed on a well head together through the position control by the hybrid tensioners.

Figure 7A:
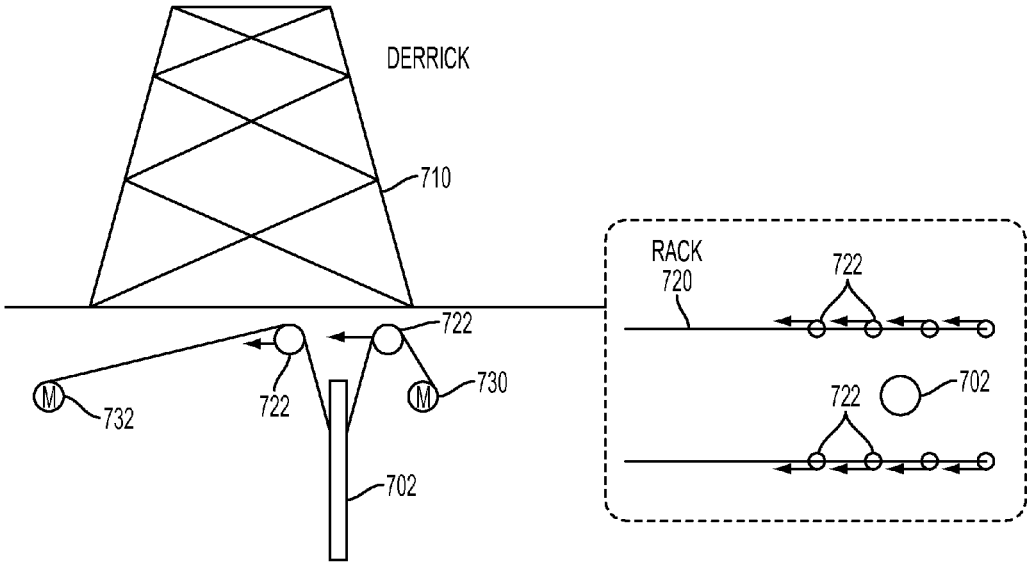
FIG. 7A is a block diagram illustrating a side and top view of a dual-activity vessel having electric tensioners when a riser string is moving from a first drilling station to the second station according to one embodiment of the disclosure.
Figure 7B:
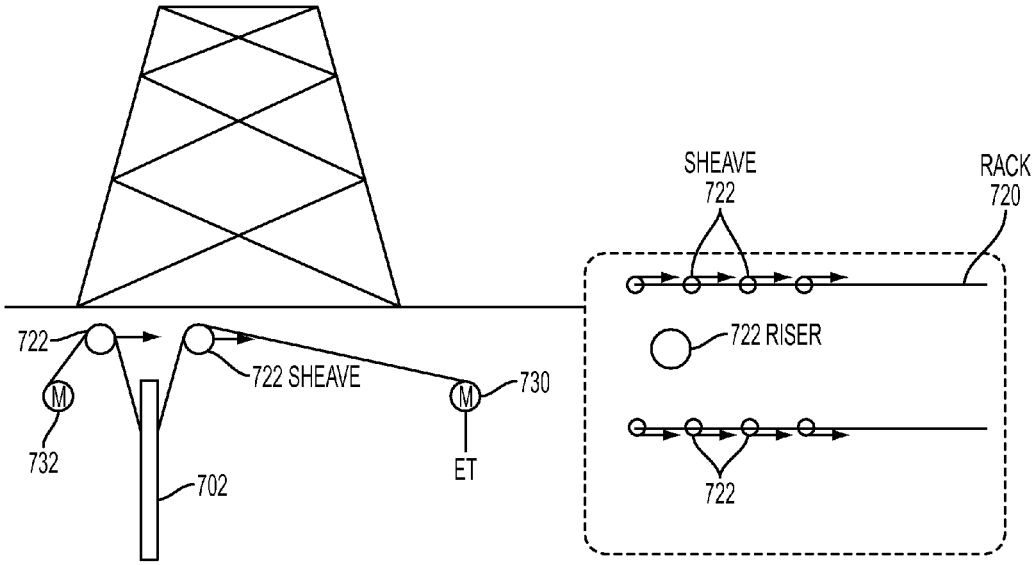
FIG. 7B is a block diagram illustrating a side and bottom view of a dual-activity vessel having electric tensioners when a riser string is moving from a second drilling station to the first station according to one embodiment of the disclosure.

Electric tensioners may also facilitate movement of a riser string from a first drilling station to another drilling station on a dual-activity vessel. For example, a first drilling station may construct the well head, and a second station may construct the riser string. Then, the electric tensioners may adjust lengths of wire coupled to the riser string to move the riser string from the second drilling station to the first drilling station. FIGS. 7A and 7B are block diagrams illustrating movement of a riser string between drilling stations by electric tensioners according to one embodiment of the disclosure. FIG. 7A illustrates a riser string 702 attached to a derrick 710. The riser string 702 may be held in place by electric tensioners 730 and 732. When the riser string 702 is attached to a second drilling station, wires coupling the electric tensioner 732 may be at high tension to roll the sheaves 722 towards the first station and also reduce length of the wires and, thus, the distance between the tensioner 732 and the riser string 702. FIG. 7B illustrates the riser string 702 attached to a derrick 710 above a first drilling station. Wires coupling the electric tensioner 730 may be adjusted to roll the sheaves 722 towards the second station and to reduce length of the wires and, thus, the distance between the riser string 702 and the tensioner 730. The tensioners 730 and 732 may be coupled to the riser 702 through sheaves 722 attached to a rack 720 on the vessel.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present processes, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An apparatus, comprising:

a direct current (DC) power distribution bus;

an energy storage system coupled to the DC power distribution bus, wherein the energy storage system comprises:

an energy storage device; and a bi-directional power converter coupled to the energy storage device and the DC power distribution bus;

a power dissipater coupled to the DC power distribution bus;

a drilling riser;

a plurality of wires coupled to the drilling riser;

a first and second electrical tensioner coupled to the drilling riser via a first and a second wire of the plurality of wires and coupled to the power distribution bus;

a hydro-pneumatic tensioner coupled to the drilling riser via a third wire of the plurality of wires; and a controller configured to perform steps comprising:

measuring tensions delivered by the hydro-pneumatic tensioner and the first and second electrical tensioner;

distributing tension to the first and second electrical tensioners based, in part, on the measured tensions of the hydro-pneumatic tensioner and the first and second electrical tensioners;

controlling the first and second electrical tensioners to adjust a tension of the first and second wires based on the step of distributing tension to the first and second electrical tensioners;

transferring energy from the energy storage device to at least one of the first and second electrical tensioners; and storing energy from at least one of the first and second electrical tensioners in the energy storage device.

2. The apparatus of claim 1, wherein the controller is configured to perform the step of transferring energy from an energy storage device by performing steps comprising:

rolling in a wire of the plurality of wires coupled to the electrical tensioner;

transferring energy from the energy storage device onto a common DC power distribution bus;

inverting energy from DC energy on the common DC power distribution bus to AC energy; and converting electrical energy into potential energy.

3. The apparatus of claim 1, wherein the controller is configured to perform the step of storing energy from at least one of the first and second electrical tensioner by performing steps comprising:

rolling out a wire coupled to at least one of the first and second electrical tensioner;

converting potential energy to alternating current electric energy;

inverting alternating current energy to direct current energy; and storing direct current energy in the energy storage device.

4. The apparatus of claim 1, wherein the controller is configured to perform steps comprising:

applying a larger tension from at least one of the first and second electrical tensioner when a vessel is falling down; and applying a smaller tension from at least one of the first and second electrical tensioners when the vessel is rising up.

5. The apparatus of claim 1, wherein the controller is further configured to perform steps comprising managing energy in the energy storage device based on at least one of state of charge, power, voltage, and current.

6. A method, comprising:

measuring a tension delivered by a plurality of electrical tensioners and a hydro-pneumatic tensioner;

determining tensions for the plurality of electrical tensioners based, in part, on the measured tensions of the plurality of electrical tensioners and the hydro-pneumatic tensioner;

distributing the determined tensions to the plurality of electrical tensioners and the hydro-pneumatic tensioner;

controlling the plurality of electrical tensioners based, in part, on the determined tension;

transferring energy from an energy storage device to an electrical tensioner of the plurality of electrical tensioners; and storing energy from an electrical tensioner of the plurality of electrical tensioners in an energy storage device.

7. The method of claim 6, wherein transferring energy from an energy storage device comprises:

rolling in a wire coupled to the electrical tensioner;

transferring energy from the energy storage device onto a common DC power distribution bus;

inverting energy from DC energy on the common DC power distribution bus to AC energy; and converting electrical energy into potential energy.

8. The method of claim 6, wherein storing energy from an electrical tensioner of the plurality of electrical tensioners comprises:

rolling out a wire coupled to the electrical tensioner;

converting potential energy to alternating current electric energy;

inverting alternating current energy to direct current energy; and storing direct current energy in the energy storage device.

9. The method of claim 6, further comprising harvesting wave energy by:

applying a larger tension from the plurality of electrical tensioners when a vessel is falling down; and applying a smaller tension from the plurality of electrical tensioners when the vessel is rising up.

10. The method of claim 6, further comprising managing energy in the energy storage device based on at least one of state of charge, power, voltage, and current.

* * * * *